US005213211A

United States Patent [19]

Umiker

[11] Patent Number: 5,213,211

[45] Date of Patent: May 25, 1993

[54] STACKABLE CONTAINER MADE FROM PLASTIC MATERIAL FOR ACCOMODATING OBJECTS, IN PARTICULAR CANS

[75] Inventor: Hans Umiker, Egg/SH, Switzerland

[73] Assignee: Schoeller-Plast SA

[21] Appl. No.: 778,934

[22] PCT Filed: May 2, 1991

[86] PCT No.: PCT/EP91/00835

§ 371 Date: Dec. 6, 1991

§ 102(e) Date: Dec. 6, 1991

[87] PCT Pub. No.: WO91/17097

PCT Pub. Date: Nov. 14, 1991

[30] Foreign Application Priority Data

May 6, 1990 [DE] Fed. Rep. of Germany ..... 4014454

[51] Int. Cl.[5] ..... B65D 85/66

[52] U.S. Cl. ..... 206/392; 206/597; 206/503; 206/821

[58] Field of Search ..... 206/503, 597, 391, 392, 206/821, 505

[56] References Cited

U.S. PATENT DOCUMENTS

| | | | |
|---|---|---|---|
| 4,667,823 | 5/1987 | Wolfe, Jr. et al. | 206/392 |
| 4,838,419 | 6/1989 | Weits et al. | 206/503 |
| 4,896,774 | 1/1990 | Hammett et al. | 206/821 |
| 4,899,874 | 2/1990 | Apps et al. | 206/821 |
| 5,016,761 | 5/1991 | Stoddard et al. | 206/821 |

FOREIGN PATENT DOCUMENTS

| | | |
|---|---|---|
| 306074 | 3/1989 | European Pat. Off. . |
| 2117934 | 7/1972 | France . |
| 1474782 | 3/1987 | France . |
| 568191 | 10/1975 | Sweden . |
| 2032886 | 5/1980 | United Kingdom . |

*Primary Examiner*—Joseph Man-Fu Moy
*Attorney, Agent, or Firm*—Remy J. VanOphem

[57] ABSTRACT

A stackable container particularly for receiving cans, having no side walls, is built with holding tongues protruding from the container bottom in an upward direction. The holding tongues disposed along the circumferential margin are arranged in a manner directed to the gaps between compartments and are dimensioned in height in such a manner that load distribution is effected through the cans received in the container.

9 Claims, 3 Drawing Sheets

STACKABLE CONTAINER MADE FROM PLASTIC MATERIAL FOR ACCOMODATING OBJECTS, IN PARTICULAR CANS

BACKGROUND OF THE INVENTION

The invention relates to stackable containers and particularly stackable containers for transporting, storing, and displaying cans.

With respect to transportation and storage it is a main goal in the food industry to minimize the space requirements of the packaging unit in relation to the goods. A further important condition lies in that the packaging units are stackable, easy to handle and that the removal of the goods from the packaging units is possible in a simple manner. Depending on the kind of market, it often is desirable that the goods can be positioned on shelves, while still being contained in the packaging unit, so that the customer can remove the goods from the packaging unit. The latter is particularly the case in the so-called discount shops or in supermarkets as well as other hypermarkets.

Herein, problems arise in particular with respect to transportation and storage of cans for food and feeding stuff, since these cans in most cases are comparatively heavy and upon formation of larger packaging units by a number of cans, the weight resulting therefrom requires a stable packaging which generally again increases the packaging volume.

Up to now when packing cans, for example cans with nutrition or cans with cat or dog feeding stuff, mainly common cardboard packagings were used, which, however, had to be broken open for removing the goods and thus were not suitable for being directly positioned on shelves. For this reason, as packaging for cans, people started to use a cardboard container open on top, having a container bottom and four side walls for accommodating the cans and covered entirely with a shrink foil. Upon removal of the shrink foil, the open top cardboard box could then be positioned on shelves so that the customer could take the goods out of the cardboard container without difficulty. The disadvantage of this kind of packaging is that two different materials are used, namely cardboard and plastic shrink foil, and moreover that the cardboard box looses stability when it becomes humid. A further disadvantage is that the cardboard packages as a rule cannot be reused, and like the shrink foil wastes have to be forwarded to a separate disposal. This is disadvantageous for environmental reasons.

SUMMARY OF THE PRESENT INVENTION

In accordance with the present invention, the container is no longer manufactured from cardboard but of plastic material, preferably in one piece, wherein the container essentially is formed without side walls by a container bottom and by holding tongues protruding in an upward direction from the container bottom. The holding tongues are disposed at the marginal side over the circumference of the container bottom, namely on a gap to the compartments and/or the cans to be received in the compartments, so that the holding tongues form suitable support faces for the cans received in the container. At the same time, the holding tongues in their height essentially correspond to the thickness of the container bottom or only slightly exceed the height of the container bottom, preferably formed as hollow profiles, and thereby contribute to the stability of the container. Due to their low height, the holding tongues in no way contribute to load distribution in the stack, but the cans received in the container are used for load distribution, so that in the stack the load from the container bottom of the stacked layer above is further distributed in a downward direction through the cans. For this reason, the container is effective in a load structure without having to show self-carrying functions. Thereby, it is possible to give the container such a design that a number of cans can be accommodated at the lowest possible volume of the container itself. This also is further supported by the arrangement of the holding tongues directed to the gaps between cans, as thereby the space between the holding tongues is free for the cans, so that in practice the dimensions of the packaging unit are defined by adding the diameters of the cans placed one beside the other in a row. The fact that there is no side wall results in a good visual display of the cans, so that separate areas for printed labels or markings can be eliminated as the content of the packaging is made obvious by the printing on the cans themselves. Due to its display function, such a container is particularly suitable for directly being displaced from the transportation unit onto a shelf.

In an advantageous manner, holding tongues are also formed in the container itself and serve to support the cans received in the container, in particular if the container is placed in a display area in an inclined position. The height of the holding tongues thus is based on the lateral holding function alone.

Advantageously, the holding tongues are formed as hollow profiles, which contributes to the stability of the container. For the purpose of stackability, it is advisable to give the holding tongues a shape tapered to its top, in particular conically tapered. Easy cleaning of the container is favored in that the holding tongues are formed open to the bottom as well as open to the top. To facilitate stacking, it is furthermore advantageous, if corresponding, preferably complementary recesses, are provided for at the container bottom in alignment with the holding tongues, i.e. below the holding tongues.

This provides good centering and accommodation of the cans in the container compartments is guaranteed in that per compartment one annular rib is formed at the top side of the container bottom, which rib upon positioning of the can is in indentational engagement with the can, in particular with a fold or bead circumferentially extending at the bottom face of the can. In the same way, a good stacking connection is caused by webs or an annular web, respectively, protruding in a downward direction and also engaging with a fold of the can, formed to the bottom side of each compartment.

For limitation of the compartments the holding tongues can be mutually connected by bottom strips, wherein in the interior of the container the holding tongues can be connected by webs or strips extending in the plane of separation of adjacent compartments. This, too, contributes to the stability of the container.

DETAILED DESCRIPTION OF THE PREFERRED EMBODIMENT

Figure 1:
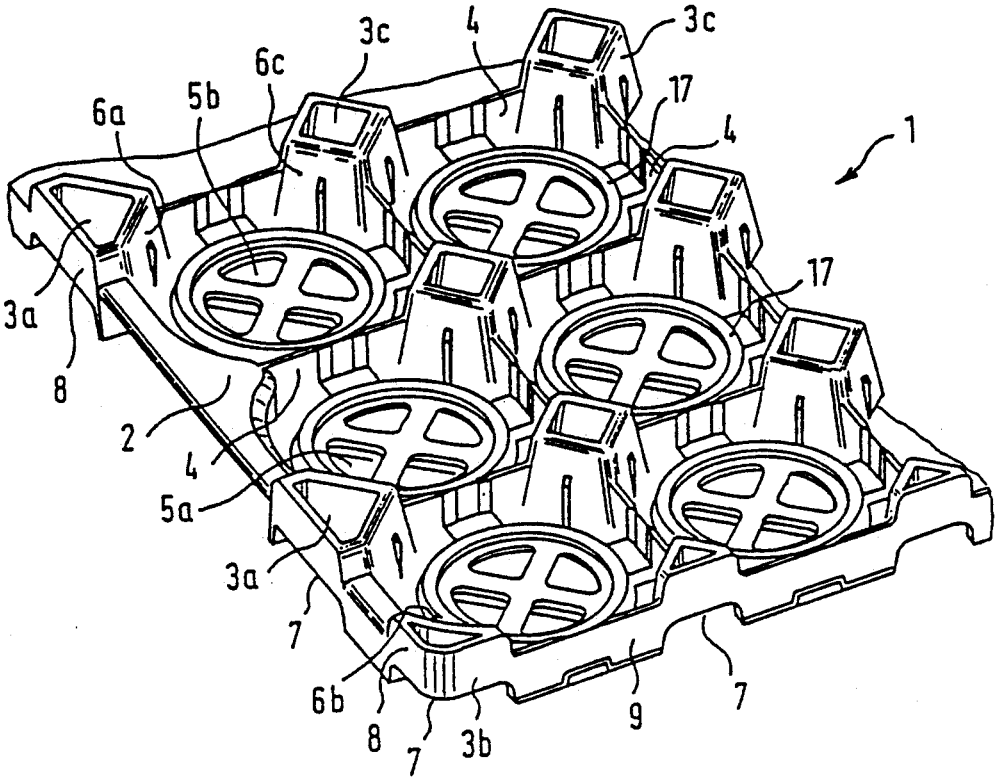
FIG. 1 is a perspective view of a container for accommodating cans according to the invention.

A container 1, shown in FIG. 1 with its corner section only, is essentially formed by a container bottom 2 and holding tongues protruding in an upward direction from the container bottom and being marked with reference numeral 3*a* in marginal arrangement, with the reference numeral 3*b* in corner arrangement, and with the reference numeral 3*c* in arrangement within the container. The holding tongues built in the manner of a protrusion herein are of small size as compared to the cans to be received, as can best be seen from FIG. 2 and as is explained in more detail below.

Figure 2:
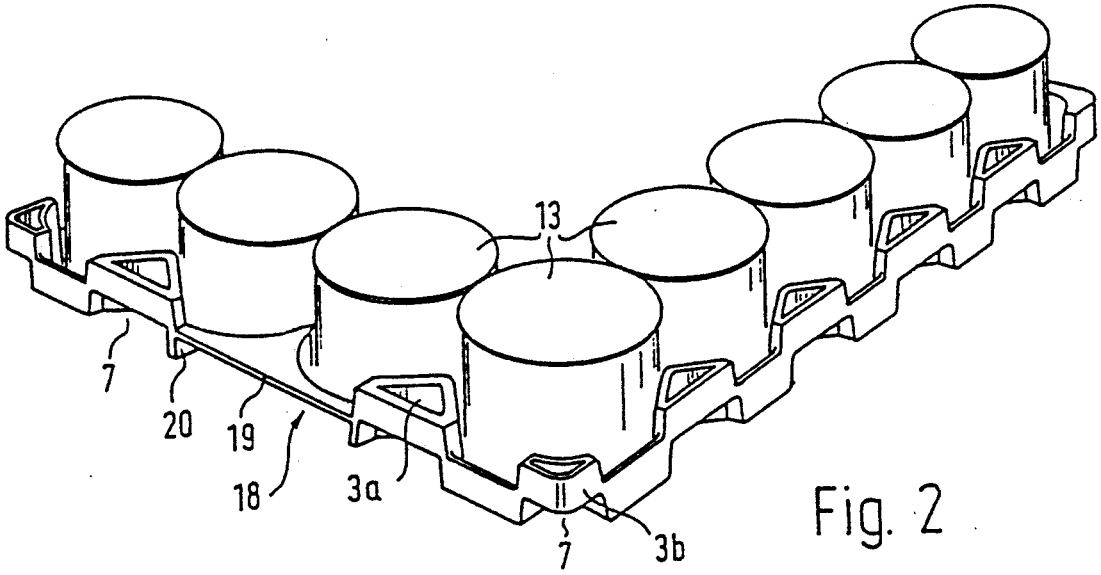
FIG. 2 is a perspective view of one marginal part of the container of FIG. 1 shown with cans received in a purely schematic representation.

The marginal holding tongues 3*a* in correspondence with FIG. 2 are arranged to the gap between cans, i.e. aligned with the plane of separation formed by a holding web 4 of low height, between two adjacent compartments 5*a* and 5*b* (FIG. 1). The holding tongues 3*a* are arranged in the point of intersection of two crossing planes of separation, again formed by strip-like holding webs 4, i.e. to the gap of the cans as well. The marginal holding tongues 3*a* and 3*b* have an essentially triangular cross-sectional area, whereas the holding tongues 3*c* arranged in the interior of the container have an essentially rhombic cross-sectional area. Herein, it is advantageous that the surfaces of the tongues facing the cans to be received are of rounded or vaulted shape adapted to the round shape of the cans for forming support and holding surfaces for the cans received in the compartments 5*a* and 5*b*. In FIG. 1 corresponding support surfaces 6*a*, 6*b*, and 6*c* are marked.

Figure 6:
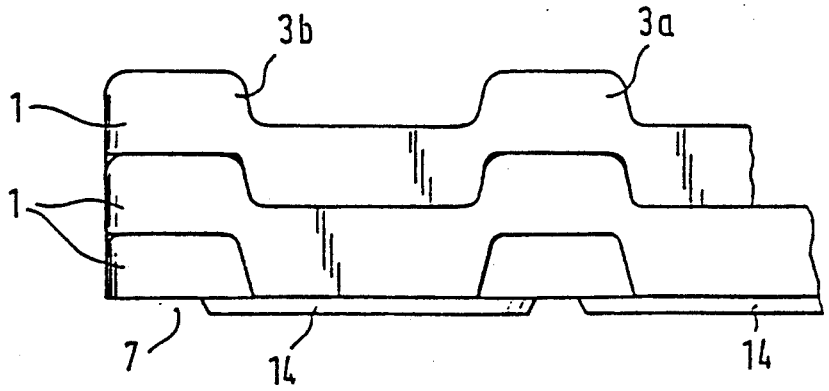
FIG. 6 is a schematic view of empty containers which are stacked, one disposed into the other.

In the embodiment shown the holding tongues are formed as hollow profiles and are conically tapered in an upward direction, so that stacking of empty containers is possible. Such stacking is additionally facilitated in that corresponding recesses 7 are provided below the holding tongues at the bottom side of the container bottom, into which the holding tongues of a lower layer can be inserted upon stacking of empty containers, as best illustrated in FIG. 6. As shown in FIG. 2, the holding tongues can be formed so as to be open on top which facilitates automatic cleaning of the containers.

An outer surface 8 of the marginal holding tongues 3*a* and 3*b* extends in line with the outer surface 8 of the container bottom, so that the holding tongues 3*a* and 3*b* protrude into the interior of the container and thus form the corresponding support surfaces 6*a* through 6*c*.

Figure 3:
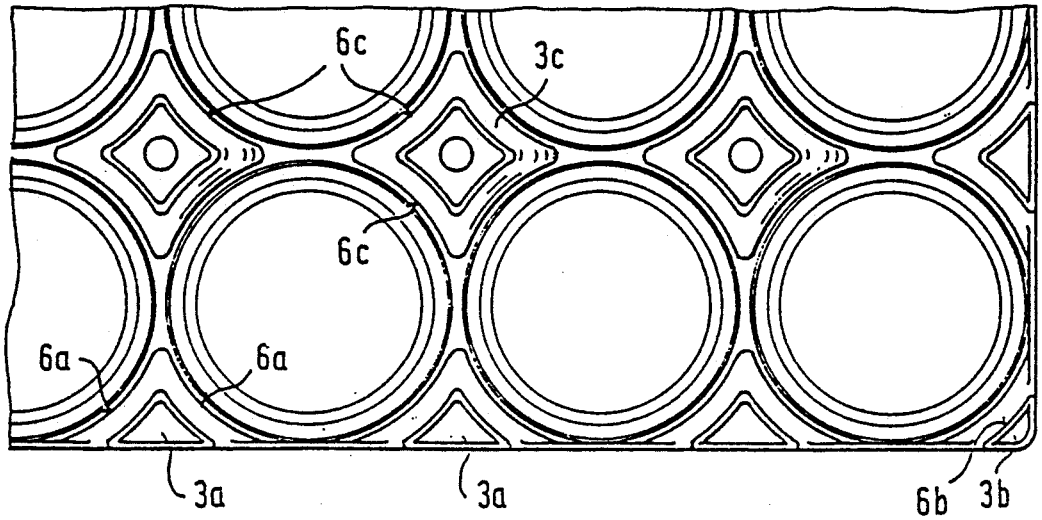
FIG. 3 is a view of part of a container with cans as seen from the top.

As can best be seen from FIG. 3, sufficient room is left between neighboring holding tongues 3*a* and 3*b* for placing the cans with their outer wall practically in line with the outer surface of the holding tongues 3*a* and 3*b*, so that the transportation volume of the container bottom can most favorably be filled by the cans. Due to these measurements in practice the outer dimensions of the container are defined by the length extension of the cans positioned in a row one beside the next. For stiffening purposes and in order to improve retention of the cans in the compartment in an inclined position on a shelf, bottom strips or bottom webs 9 are provided which, together with the webs 4 in the planes of separation, define the compartments. The webs 9 and 4 are of low height as compared to the height of the holding tongues and in a practical embodiment are formed by recesses in the container bottom for forming the compartments.

Figure 4:
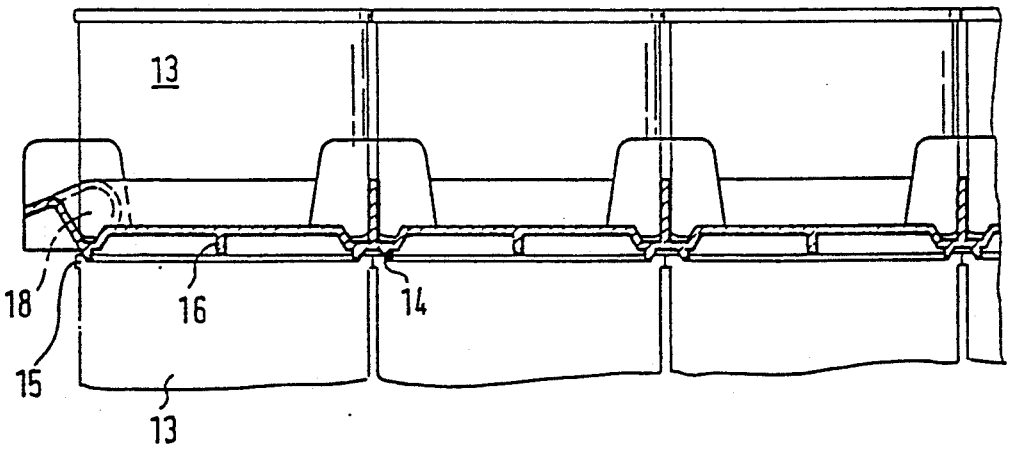
FIG. 4 is a sectional view through a part of the container with received cans and a container of a lower stacking layer.
Figure 5:
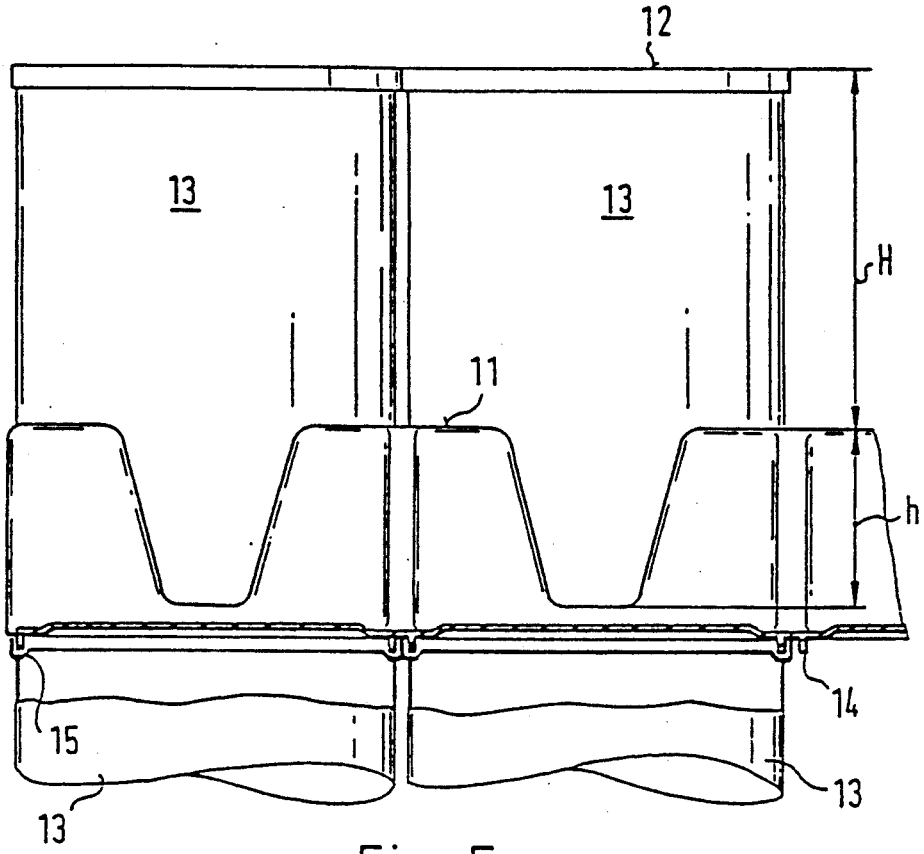
FIG. 5 is a sectional view similar to FIG. 4, of an alternate embodiment of the invention.

As can be particularly seen from FIGS. 4 and 5, the height of the holding tongues is substantially less than the height of the cans received in the container, wherein the height of the holding tongues is dictated by a lateral support function for the cans, in particular in the case of an inclined arrangement on a shelf. This results in an almost free display surface for the cans, so that the container fulfills an optimum display function. Indicia on the container can be eliminated since the contents of the container can be recognized from the print on the cans which is clearly visible. Moreover, the holding tongues meet a certain stabilizing function for the container which is decreased in terms of thickness. In accordance with FIG. 5, the height h of the holding tongues 3*a* through 3*c* is less than the distance H between an upper surface 11 of the tongues 3*a* through 3*c* and an upper surface 12 of the cans 13 to be accommodated in the container. Thereby, the cans 13 received in the container participate in load distribution when the containers are arranged in a stack, in that the loads are directly distributed through the container bottom of the stacked layer located directly above into the cans of the stacked layer located below. Thereby it is no longer required that the container is made self-supporting, which permits a side wall-free embodiment and the low height of the holding tongues.

It can be seen from FIGS. 4 and 5 as well, that the webs protruding in a downward direction, preferably annular webs 14, are formed to the bottom side of the container bottom, which webs are adapted to the annular bead 15 of the cans. In the embodiment according to FIG. 4 the web 14 of each compartment engages within or alternatively outside the annular bead 15 or the like, of the can positioned therebelow, so that a centering and a solid stacking connection will result. For stiffening the container bottom, stiffening ribs 16, seen in FIG. 4 arranged in a cross-shaped manner, are provided at the container bottom. A load distribution into the can is also effected therethrough. In the embodiment according to FIG. 5, too, the indentational engagement of the container bottom with the can of the lower stacking layer can be seen, in which a ring-shaped web 14 with a bead groove 17 engages with a can arranged therebelow. By bottom sections adapted to the basic shape, here by cross webs within the annular rib 17 in accordance with FIG. 1, for example, the lightweight construction is stuck to and residual water, e.g. from a washing process, can flow out from the various level areas of the bottom. The design of the bottom of the mentioned cross webs or rings or the like leads to a partial support of the cans, whereby an aeration of the can bottom is guaranteed and it is possible to dry out the container without difficulty. This is important for rust prevention and protection against corrosion of the cans.

For simplification of handling, grip recesses 18, to be seen from FIGS. 2 and 4, are built at the side walls, which recesses in accordance with FIG. 2 can also be formed by a bottom-side web 19 in connection with strips 20 protruding in a downward direction.

At the upper side of the container bottom one centering means for the cans to be received is provided for each compartment, which means in the embodiment of FIG. 1 is formed by a protruding annular rib 17 overlapped by the annular bead at the bottom side of the can to be received. In a practical embodiment four rows of cans with five cans per row, i.e. 20 cans, are accommodated in a container for receiving cans with cat or dog food or the like, with a rectangular base area of the container bottom with two narrow and two long sides. The wall thickness of the holding tongues and the remaining webs herein can amount to 2 mm. Nevertheless, good stability, and excellent stacking capability with good load distribution is achieved.

Although the invention has been described in detail with reference to the illustrated preferred embodiment, variations and modifications exist within the scope and spirit of the invention as described and as defined in the following claims.

What is claimed is:

1. A stackable container for transporting and storing objects, such as a plurality of cans, said stackable container having an upper surface for receiving said plurality of cans and a lower surface for nesting with an empty stackable container stacked below said stackable container, said stackable container comprising:

a base, said base defining a plurality of corners and being substantially open between adjacent pairs of said plurality of corners so as to permit access to said plurality of cans received in said upper surface when another said stackable container is stacked upon said stackable container;

compartments for receiving said plurality of cans formed in said upper surface of said base, each adjacent pair of said compartments defining separation planes therebetween, each of said compartments having an annular rib centrally located therein for supporting one of said plurality of cans; and means projecting from said base for restraining each of said plurality of cans within each of said compartments, said restraining means being located at the intersection of each pair of separation planes so as to form interior restraining means on said upper surface and peripheral restraining means along a periphery of said upper surface, said restraining means also being located at each of said plurality of corners so as to form corner restraining means, each said restraining means projecting from said base a distance less than a height of one of said plurality of cans, each said interior restraining means having a substantially rhombic cross-section, and each said peripheral restraining means and each said corner restraining means having a substantially triangular cross-section, each said restraining means defining a recess open to said lower surface of said base for receiving a corresponding restraining means of said empty stackable container;

whereby said rhombic cross-section and said triangular cross-section optimize the construction of said stackable container by allowing said plurality of cans to be positioned close together within said stackable container.

2. The stackable container of claim 1 wherein each said restraining means is conically tapered.

3. The stackable container of claim 1 further comprising a plurality of annular webs disposed on said lower surface such that one of said plurality of annular webs corresponds to a corresponding one of said stackable containers, said annular webs being provided for engagement with an upper surface of a corresponding one of said plurality of cans contained within another of said stackable containers stacked below said stackable container.

4. The stackable container of claim 1 further comprising an outer web formed along the periphery of said stackable container so as to extend between each adjacent pair of said peripheral restraining means and between each adjacent pair of said peripheral restraining means and said corner restraining means, said outer web projecting from said upper surface of said base so as to define an outer wall of said stackable container.

5. The stackable container of claim 4 wherein said outer web is created by a recess formed in said lower surface of said base.

6. The stackable container of claim 1 further comprising webs formed along each said separation plane so as to extend between each said restraining means, said webs projecting from said upper surface so as to define each said compartment.

7. The stackable container of claim 1 wherein said peripheral and corner restraining means are flush with the periphery of said stackable container, said peripheral and corner restraining means protruding into the interior of said stackable container.

8. The stackable container of claim 1 further comprising gripping formed at the periphery of said stackable container.

9. The stackable container of claim 1 wherein each said restraining means has arcuate holding and support surfaces which substantially conform to the shape of one of said plurality of cans.

* * * * *

UNITED STATES PATENT AND TRADEMARK OFFICE

CERTIFICATE OF CORRECTION

PATENT NO. : 5,213,211

DATED : May 25, 1993

INVENTOR(S) : Hans Umiker

It is certified that error appears in the above-identified patent and that said Letters Patent is hereby corrected as shown below:

Front page, title, delete "ACCOMODATING" and insert ---- ACCOMMODATING ----.

Column 1, line 2, delete "ACCOMODATING" and insert ---- ACCOMMODATING ----.

Column 6, line 45, after "gripping" insert ---- means ----.

Signed and Sealed this

Twenty-fifth Day of January, 1994

Bruce Lehman

*Attest:*

BRUCE LEHMAN

*Attesting Officer*

*Commissioner of Patents and Trademarks*